US010610024B2

(12) United States Patent
Carrera

(10) Patent No.: US 10,610,024 B2
(45) Date of Patent: Apr. 7, 2020

(54) SEATING AND/OR LOUNGING FURNITURE

(71) Applicant: CIAR S.P.A., Pesaro (IT)

(72) Inventor: Massimo Carrera, Tavullia (IT)

(73) Assignee: CIAR S.P.A., Pesaro (IT)

( * ) Notice: Subject to any disclaimer, the term of this patent is extended or adjusted under 35 U.S.C. 154(b) by 0 days.

(21) Appl. No.: 16/130,036

(22) Filed: Sep. 13, 2018

(65) Prior Publication Data

US 2019/0082850 A1 Mar. 21, 2019

(30) Foreign Application Priority Data

Sep. 20, 2017 (DE) ..... 20 2017 105 693 U

(51) Int. Cl.
*A47C 7/50* (2006.01)
*A47C 1/034* (2006.01)
*A47C 1/031* (2006.01)

(52) U.S. Cl.
CPC ..... *A47C 7/5062* (2018.08); *A47C 1/031* (2013.01); *A47C 1/0345* (2013.01); *A47C 7/503* (2013.01)

(58) Field of Classification Search
CPC ..... A47C 7/502; A47C 7/503; A47C 1/031
USPC ..... 297/84
See application file for complete search history.

(56) References Cited

U.S. PATENT DOCUMENTS

2010/0320809 A1 12/2010 Roleder et al.
2014/0091745 A1* 4/2014 Marcantoni ..... A47C 1/0242 318/490
2016/0367027 A1 12/2016 Voight et al.
2017/0258231 A1 9/2017 Parker et al.

OTHER PUBLICATIONS

German Search Report dated May 18, 2018.

* cited by examiner

*Primary Examiner* — Mark R Wendell
(74) *Attorney, Agent, or Firm* — Renner Kenner Greive Bobak Taylor & Weber

(57) ABSTRACT

Seating and/or lounging furniture with a footrest coupled to a frame via a linkage mechanism designed as a scissor mechanism. A drive mechanism extends and retracts the footrest, and includes:

at least one first linkage articulatedly fastened at one end to a first hinge point on the frame, and having a second end with a second hinge point, at least one second linkage articulatedly coupled at a first end to the first linkage at the second hinge point, and having a second end coupled to a third hinge point provided on the linkage mechanism, and the first and second hinge points defining a first straight line, and the second and third hinge points defining a second straight line, in an extended position of the footrest, the first and second straight lines enclosing an angle of 180°+/−5° relative to one another.

10 Claims, 4 Drawing Sheets

SEATING AND/OR LOUNGING FURNITURE

TECHNICAL FIELD

The invention relates to seating and/or lounging furniture having an extendable and retractable footrest.

BACKGROUND

Footrests are typically coupled to a frame of the seating and/or lounging furniture via a linkage mechanism, and are extended and retracted via a drive mechanism. However, the extended footrests are usually designed for the weight of the resting feet of a user. Heavier loads, which result, for example, when a person sits on the extended footrest thus generally result in irreversible damage/deformation to the drive mechanism. A majority of the repairs to such seating and/or lounging furniture are therefore attributable to damage from improper use of the footrests.

US 2010/0320809 A1 discloses a pedicure lounger with a seat support, a footrest and a mover assembly. The foot support is coupled to the seat support by a hinge member. The mover assembly includes an actuator that independently and consecutively moves the foot support rotationally and translationally relative to the seat support between an extended configuration and a retracted configuration.

SUMMARY

The object of the invention is to refine the seating and/or lounging furniture with an extendable and retractable footrest in such a way that the footrest may be subjected to heavier loads without resulting in damage/deformation to the drive mechanism.

According to the invention, this object is achieved by seating and/or lounging furniture having an extendable and retractable footrest, in which the footrest is coupled to a frame of the seating and/or lounging furniture via a linkage mechanism, which is designed in the manner of a scissor mechanism, and a drive mechanism for extending and retracting the footrest is provided. The drive mechanism is made up essentially of

- at least one first linkage which at a first end is articulatedly fastened to a first hinge point on the frame, and which has a second end with a second hinge point,
- at least one second linkage which at a first end is articulatedly coupled to the first linkage at the second hinge point, and which has a second end that is coupled to a third hinge point that is provided on the linkage mechanism of the footrest, and
- an actuator that is connected to the at least one first linkage for rotating the first linkage about the first hinge point, an actuation of the actuator causing an adjustment of the footrest between a retracted and an extended position, and
- wherein the first and second hinge points define a first straight line, and the second and third hinge points define a second straight line, in the extended position the first and second straight lines enclosing an angle of 180°+/−5°, preferably +/−2°, and most preferably +/−0.2°, relative to one another.

Due to the design according to the invention for the drive mechanism, forces acting on the footrest may be conducted directly into the frame of the seating and/or lounging furniture. These forces thus essentially do not act on the actuator, and also cannot cause damage at that location.

According to one preferred embodiment of the invention, the first, second, and third hinge points are aligned with one another in the extended position of the footrest. The first and/or second linkage may have at least one stop element that prevents the first and second linkages from rotating beyond the dead center. The first and second linkages preferably have an elongated design, so that in the extended position the two linkages lie essentially on a shared straight line.

In addition, in the extended position of the footrest the first and second linkages are preferably aligned with one another in such a way that at least 95%, preferably at least 99%, and most preferably 100%, of any forces that are introduced via the footrest and conducted via the second and first linkages are conducted into the frame, thereby bypassing the actuator.

BRIEF DESCRIPTION OF THE DRAWINGS

Further embodiments of the invention are the subject matter of the following description of one exemplary embodiment and of the drawings, which show the following.

DESCRIPTION

Figure 1:
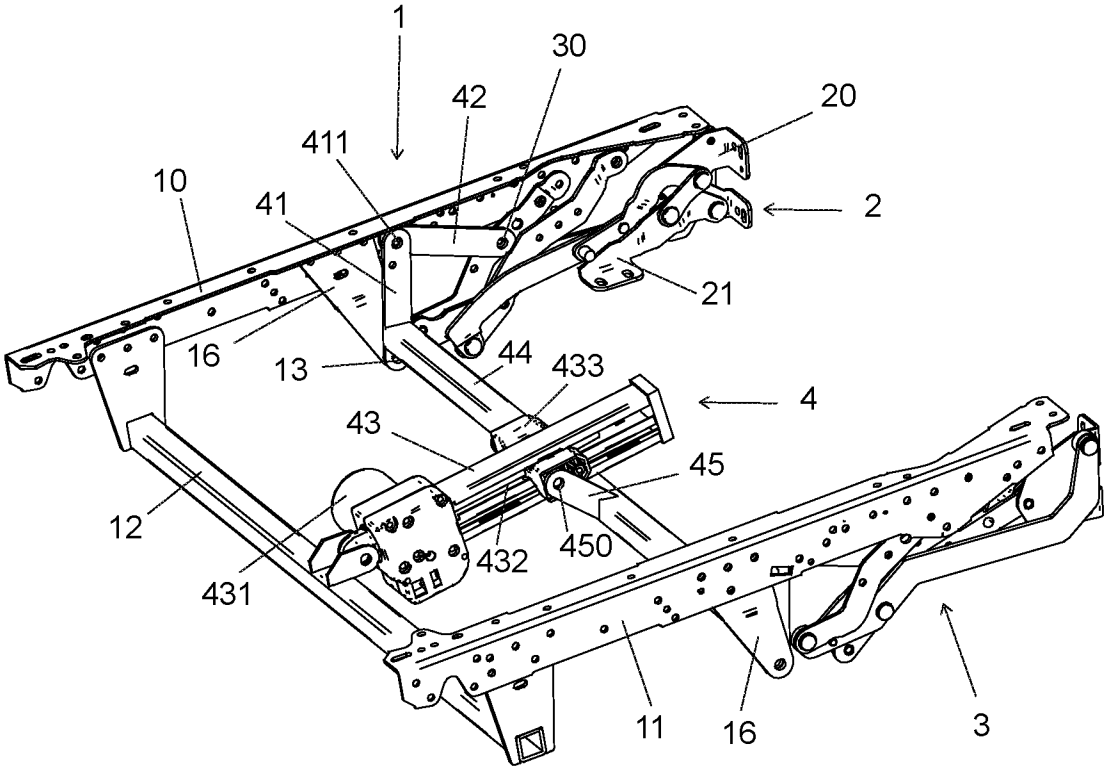
FIG. 1 shows a three-dimensional illustration of the mechanism of the seating and/or lounging furniture, with a retracted footrest.

The drawings illustrate only the portion of the mechanism of the seating and/or lounging furniture that is of particular interest for the present invention. In the figures, reference numeral 1 denotes a frame that includes a first frame element and a second side frame element 10, 11, respectively, which are connected to one another via a crossbeam 12. The frame 1 is also used for holding a seat or a seat mechanism, and a backrest or a backrest mechanism (not illustrated in greater detail). In addition, a footrest 2 is coupled to the frame 1 via a linkage mechanism 3. The footrest 2 and the linkage mechanism 3 have a two-part design here, a first part being coupled to the first side frame part 10, and a second part being coupled to the second side frame part 11. The two parts have a mirror image design with respect to a longitudinal center plane of the mechanism.

In addition, for extending and retracting the footrest 2, a drive mechanism 4 is provided which includes a first linkage 41, a second linkage 42, and an actuator 43. The first linkage 41 at a first end is articulatedly fastened at a first hinge point 13 to the frame 1 or to a retaining bracket 16 mounted on the frame, and at its second end has a second hinge point 411. The second linkage 42 on its first end is coupled to the first linkage 41 at the second hinge point 411, and on its second end is coupled to a third hinge point 30 that is provided on the linkage mechanism 3 of the footrest 2.

Figure 2:
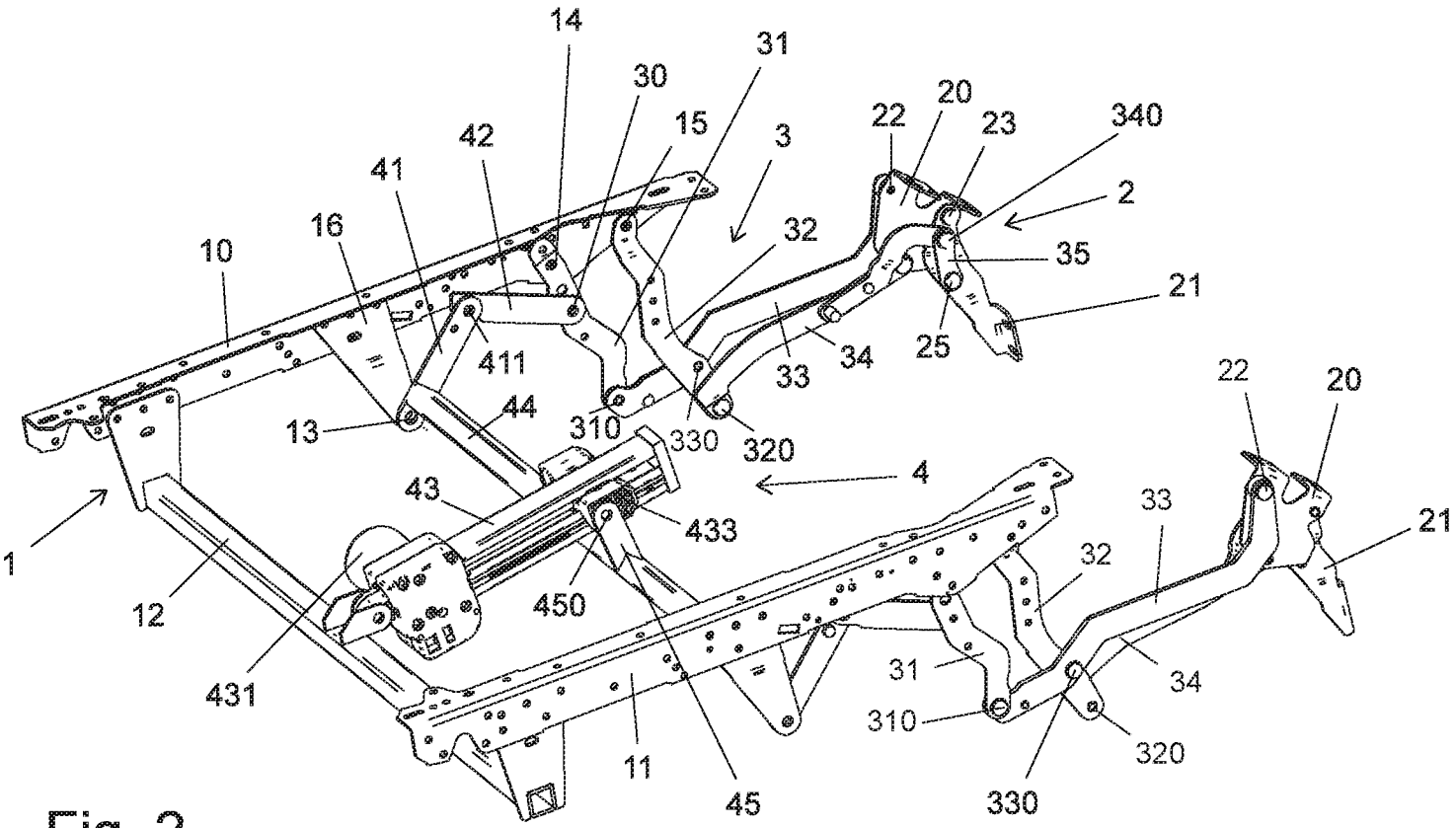
FIG. 2 shows a three-dimensional illustration of the mechanism of the seating and/or lounging furniture, with a half-extended footrest.

The actuator 43 is designed here as a linear actuator that includes a threaded spindle 432 which is rotatable via a motor 431, and an adjusting nut 433 that is displaceable by the rotary movement of the threaded spindle 432. The drive mechanism 4 also includes a transverse bracket 44 that extends transversely with respect to the two side frame parts 10, 11 and transversely with respect to the direction of movement of the adjusting nut 433. The ends of the transverse bracket 44 are each rotatably fixedly connected to the first linkages 41 that are provided on both sides of the mechanism. The linkages 41 are oriented approximately perpendicularly with respect to the transverse bracket 44. In a middle area of the transverse bracket 44, short retaining arms 45 are provided, which at one end are rotatably fixedly connected to the transverse bracket, and at the other end are connected to the adjusting nut 433 so as to be articulatable about a hinge point 450. Actuating the actuator 43 causes a displacement of the adjusting nut 433 along the threaded spindle 432, and via the retaining arms 45 and the transverse bracket 44 rotates the first linkage 41 about the first hinge point 13, as the result of which the footrest, due to its linkage mechanism 3, is extended from the retracted position according to FIG. 1 into the positions in FIGS. 2 and 3. A corresponding opposite actuation of the actuator 43 causes a displacement of the adjusting nut 433 in the opposite direction, so that the footrest is retracted.

For this purpose, the linkage mechanism 3 of the footrest 2 is designed in the manner of a scissor mechanism, and is made up of a first, second, third, and fourth scissor linkage 31-34, wherein the first scissor linkage 31 is articulatedly fastened at a fifth hinge point 14, and the second scissor linkage 32 is articulatedly fastened at a sixth hinge point 15, to the first side frame part 10, 11. The third scissor linkage 33 at one end is articulatedly coupled at a seventh hinge point 310 to the first scissor linkage 31, and the fourth scissor linkage 34 at one end is articulatedly coupled at an eighth hinge point 320 to the second scissor linkage 32.

The footrest 2 has a two-part design here, wherein a first part 20 of the footrest 2 at a ninth hinge point 22 is articulatedly connected to the third scissor linkage 33. The second part 21 of the footrest 2 at a tenth hinge point 23 is articulatedly connected to the first part 20. In addition, the second part 21 of the footrest 2, with a fifth scissor linkage 35 connected in between, is articulatedly coupled via a twelfth and thirteenth hinge point 25, 340 to the fourth scissor linkage 34. For forming the scissor linkage, in addition the second and third scissor linkages 32, 33 are articulatedly connected to one another at a fourteenth hinge point 330.

Figure 3:
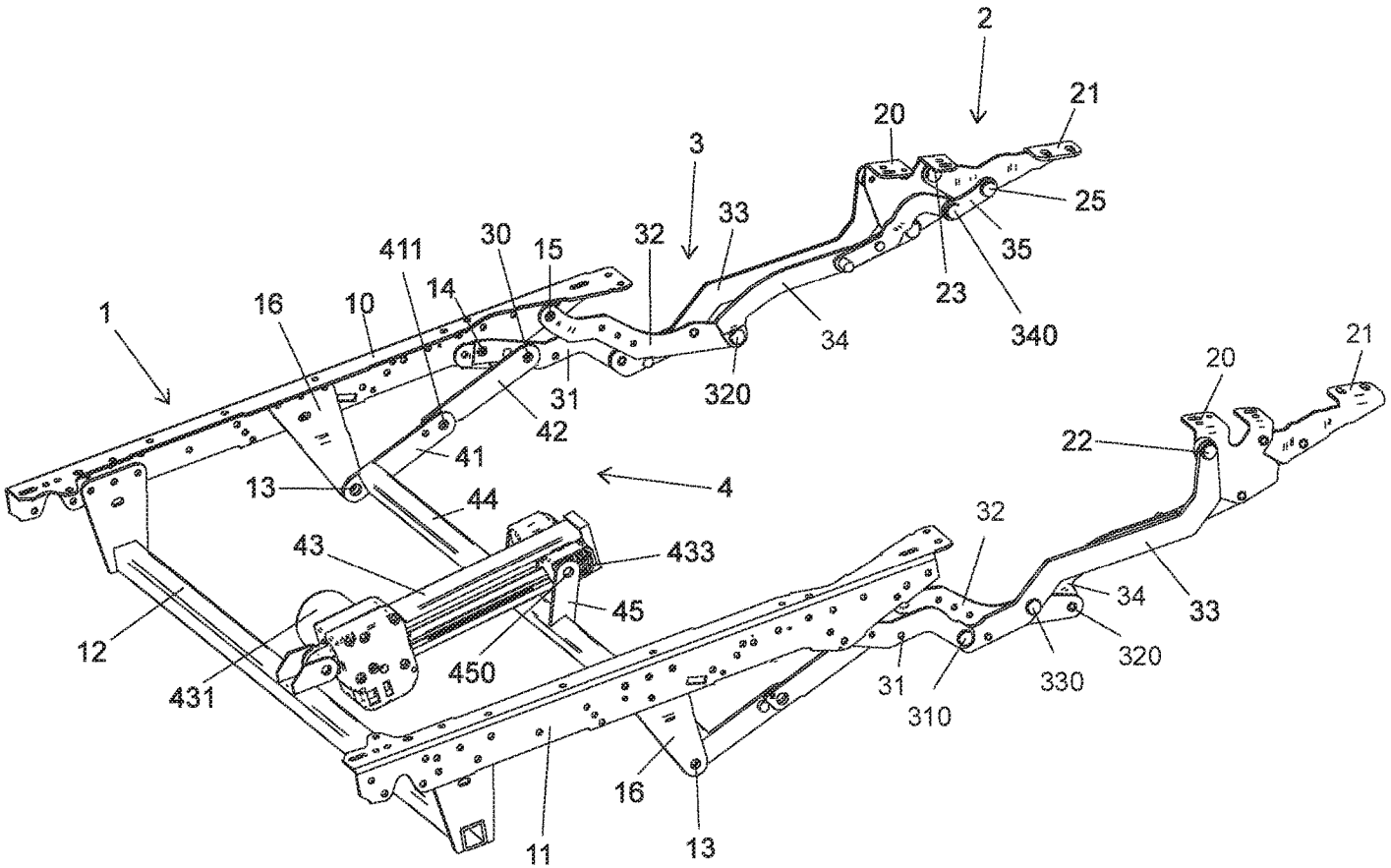
FIG. 3 shows a three-dimensional illustration of the mechanism of the seating and/or lounging furniture, with an extended footrest.
Figure 4:
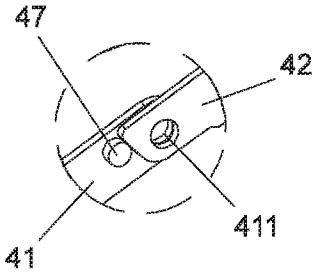
FIG. 4 shows a three-dimensional detailed view of the stop element in the area of the first linkage.
Figure 5:
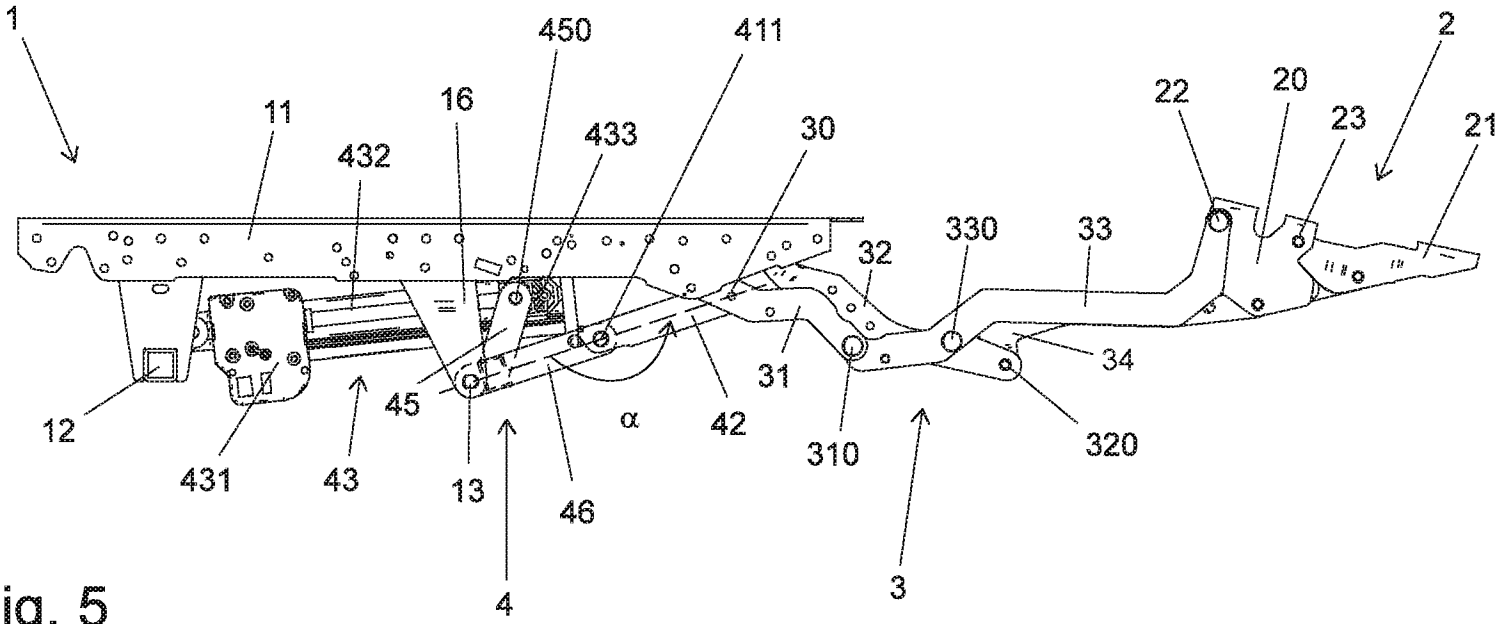
FIG. 5 shows a side view of the mechanism of the seating and/or lounging furniture, with an extended footrest.

The extended position of the footrest 2 is shown in FIGS. 3 through 5. It is apparent that the first linkage 41 and the second linkage 42 are oriented in such a way that the first hinge point 13 and the second hinge point 411 define a first straight line, and the second hinge point 411 and the third hinge point 30 define a second straight line, wherein the first and second straight lines in the extended position enclose an angle $\alpha$ of 180° relative to one another. However, within the scope of the invention it would be conceivable for the angle $\alpha$ to deviate by up to +/−5°, preferably by no more than +/−2°, and most preferably by no more than +/−0.2°, from 180°. Ideally, however, the first, second, and third hinge points 13, 411, 30 are aligned with one another, i.e., lie on a shared straight line 46, as is apparent from FIG. 5.

The first and second linkages 41, 42 are at their dead center when the acting force vectors lie on the shared straight line 46. To now prevent the first and second linkages 41, 42 from rotating beyond the dead center, at least one stop element 47 is provided, which in the illustrated exemplary embodiment (FIG. 4) is fastened to the first linkage 41 and forms a stop for the second linkage 42 in the "dead center position."

Due to a preferably flush alignment of the first and second linkages 41, 42, at least 95%, preferably at least 99%, and most preferably 100%, of the forces introduced via the footrest 2 and conducted via the first and second linkages 41, 42 are conducted into the frame 1. The majority of the forces are conducted via the first and second linkages 41, 42, and are introduced into the two side frame parts 10, 11 of the frame 1 in the area of the first hinge points 13. The first hinge point 13 is provided on a retaining bracket 16 that has an appropriately stable design and is rigidly connected to the first and second side frame parts 10, 11. The (preferably) flush alignment of the first, second, and third hinge points 13, 411, 30 also prevents the forces that act via the footrest from being transmitted via the transverse bracket 44 and the retaining arms 45 to the adjusting nut 433 and the threaded spindle 432 to an extent that would result in damage to the actuator 43.

With an essentially flush alignment and an appropriately stable design of the linkage mechanism, it is even conceivable to design the footrest for a weight load of 70 kg and greater.

The invention claimed is:

1. Seating and/or lounging furniture having an extendable and retractable footrest that is coupled to a frame of the seating and/or lounging furniture via a linkage mechanism which is designed in the manner of a scissor mechanism and a drive mechanism for extending and retracting the footrest, having at least one first linkage which at a first end is articulatedly fastened to a first hinge point on the frame, and which has a second end with a second hinge point, at least one second linkage which at a first end is articulatedly coupled to the first linkage at the second hinge point, and which has a second end that is coupled to a third hinge point that is provided on the linkage mechanism of the footrest, and an actuator that is connected to the at least one first linkage for rotating the first linkage about the first hinge point, an actuation of the actuator causing an adjustment of the footrest between a retracted and an extended position, and wherein the first and second hinge points define a first straight line, and the second and third hinge points define a second straight line, in the extended position the first and second straight lines enclosing an angle of 180°+/−5° relative to one another, wherein the linkage mechanism of the footrest which is designed in the manner of a scissor mechanism, is made up of a first, second, third, and fourth scissor linkage, wherein the first scissor linkage is articulatedly fastened at a fifth hinge point and the second scissor linkage is articulatedly fastened at a sixth hinge point, to the first side frame part and wherein the third scissor linkage at one end is articulatedly coupled at a seventh hinge point to the first scissor linkage, and the fourth scissor linkage at one end is articulatedly coupled at an eighth hinge point to the second scissor linkage and, for forming the scissor linkage, in addition the second and third scissor linkages are articulatedly connected to one another at a fourteenth hinge point, and the fourteenth hinge point is between the sixth hinge point and the eight hinge point along the length of the second scissor linkage.

2. The seating and/or lounging furniture according to claim 1, wherein the first, second, and third hinge points are aligned with one another in the extended position.

3. The seating and/or lounging furniture according to claim 1, wherein the frame includes a first frame element and a second side frame element, respectively, which are connected to one another via a crossbeam.

4. The seating and/or lounging furniture according to claim 3, wherein the footrest and the linkage mechanism have a two-part design, a first part being coupled to the first side frame part, and a second part being coupled to the second side frame part and wherein the two parts have a mirror image design with respect to a longitudinal center plane of the drive mechanism.

5. The seating and/or lounging furniture according to claim 1, wherein the actuator is designed as a linear actuator that includes a threaded spindle which is rotatable via a motor, and an adjusting nut that is displaceable by the rotary movement of the threaded spindle.

6. The seating and/or lounging furniture according to claim 3, wherein the actuator is designed as a linear actuator that includes a threaded spindle which is rotatable via a motor, and an adjusting nut that is displaceable by the rotary movement of the threaded spindle and wherein the drive mechanism also includes a transverse bracket that extends transversely with respect to the two side frame parts and transversely with respect to the direction of movement of the adjusting nut, wherein the ends of the transverse bracket are each rotatably fixedly connected to the first linkages that are provided on both sides of the mechanism.

7. The seating and/or lounging furniture according to claim 1, wherein the first and second linkages have an elongated design.

8. The seating and/or lounging furniture according to claim 1, wherein the first and/or second linkage has/have at least one stop element that prevents the first and second linkages from rotating beyond the dead center.

9. The seating and/or lounging furniture according to claim 1, wherein the extended position the first and second linkages lie on a shared straight line.

10. The seating and/or lounging furniture according to claim 1, wherein in the extended position of the footrest the first and second linkages are aligned with one another in such a way that at least 95% of the forces that are introduced via the footrest and conducted via the second and first linkages are conducted into the frame, thereby bypassing the actuator.

* * * * *